US007101493B2

(12) United States Patent
Colucci

(10) Patent No.: US 7,101,493 B2
(45) Date of Patent: Sep. 5, 2006

(54) METHOD AND COMPOSITION FOR SUPPRESSING COAL DUST

(75) Inventor: William J. Colucci, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 150 days.

(21) Appl. No.: 10/651,140

(22) Filed: Aug. 28, 2003

(65) Prior Publication Data

US 2005/0045853 A1 Mar. 3, 2005

(51) Int. Cl.
*C09K 3/22* (2006.01)

(52) U.S. Cl. ..... 252/88.2
(58) Field of Classification Search ..... 252/88.1, 252/88.2; 426/89
See application file for complete search history.

(56) References Cited

U.S. PATENT DOCUMENTS

| | | | | |
|---|---|---|---|---|
| 2,086,775 | A | | 7/1937 | Lyons et al. |
| 2,151,432 | A | | 3/1939 | Lyons et al. |
| 2,818,417 | A | | 12/1957 | Brown et al. |
| 3,927,992 | A | | 12/1975 | Kerley |
| 4,036,605 | A | | 7/1977 | Hartle |
| 4,104,036 | A | | 8/1978 | Chao et al. |
| 4,139,349 | A | | 2/1979 | Payne |
| 4,175,927 | A | | 11/1979 | Niebylski |
| 4,266,946 | A | | 5/1981 | Niebylski |
| 4,317,657 | A | | 3/1982 | Niebylski |
| 4,390,345 | A | | 6/1983 | Somorjai |
| 4,425,252 | A | * | 1/1984 | Cargle et al. ..... 252/88.1 |
| 4,474,580 | A | | 10/1984 | MacKenzie et al. |
| 4,568,357 | A | | 2/1986 | Simon |
| 4,588,416 | A | | 5/1986 | Zaweski et al. |
| 4,664,677 | A | | 5/1987 | Dorer, Jr. et al. |
| 4,670,020 | A | | 6/1987 | Rao |
| 4,674,447 | A | | 6/1987 | Davis |
| 4,801,332 | A | * | 1/1989 | Selfridge et al. ..... 106/273.1 |
| 4,804,388 | A | | 2/1989 | Kukin |
| 4,891,050 | A | | 1/1990 | Bowers et al. |
| 4,908,045 | A | | 3/1990 | Farrar |
| 4,946,609 | A | | 8/1990 | Pruess et al. |
| 4,955,331 | A | | 9/1990 | Hohr et al. |
| 5,034,020 | A | | 7/1991 | Epperly et al. |
| 5,113,803 | A | | 5/1992 | Hollran et al. |
| 5,340,369 | A | | 8/1994 | Koch et al. |
| 5,376,154 | A | | 12/1994 | Daly et al. |
| 5,501,714 | A | | 3/1996 | Valentine et al. |
| 5,551,957 | A | | 9/1996 | Cunningham et al. |
| 5,584,894 | A | | 12/1996 | Peter-Hoblyn et al. |
| 5,599,357 | A | | 2/1997 | Leeper |
| 5,658,486 | A | * | 8/1997 | Rogers et al. ..... 252/88.1 |
| 5,679,116 | A | | 10/1997 | Cunningham et al. |
| 5,732,548 | A | | 3/1998 | Peter-Hoblyn |
| 5,758,496 | A | | 6/1998 | Rao et al. |
| 5,809,774 | A | | 9/1998 | Peter-Hoblyn et al. |
| 5,809,775 | A | | 9/1998 | Tarabulski et al. |
| 5,813,224 | A | | 9/1998 | Rao et al. |
| 5,819,529 | A | | 10/1998 | Peter-Hoblyn |
| 5,891,423 | A | * | 4/1999 | Weeks ..... 424/62 |
| 5,912,190 | A | | 6/1999 | Barr et al. |
| 5,919,276 | A | | 7/1999 | Jeffrey |
| 5,924,280 | A | | 7/1999 | Tarabulski |
| 5,928,392 | A | | 7/1999 | Aradi |
| 5,944,858 | A | | 8/1999 | Wallace |
| 5,953,906 | A | | 9/1999 | Gamel et al. |
| 5,976,475 | A | | 11/1999 | Peter-Hoblyn et al. |
| 6,003,303 | A | | 12/1999 | Peter-Hoblyn et al. |
| 6,023,928 | A | | 2/2000 | Peter-Hoblyn et al. |
| 6,051,040 | A | | 4/2000 | Peter-Hoblyn |
| 6,056,792 | A | | 5/2000 | Barr et al. |
| 6,086,647 | A | | 7/2000 | Rahm et al. |
| 6,152,972 | A | | 11/2000 | Shustorovich et al. |
| 6,193,767 | B1 | | 2/2001 | Arters et al. |
| 6,200,358 | B1 | | 3/2001 | Fleischer et al. |
| 6,361,754 | B1 | | 3/2002 | Peter-Hoblyn et al. |
| 2002/0066394 | A1 | * | 6/2002 | Johnson et al. ..... 110/342 |
| 2002/0112466 | A1 | | 8/2002 | Roos et al. |
| 2003/0027014 | A1 | | 2/2003 | Johnson et al. |

FOREIGN PATENT DOCUMENTS

| | | |
|---|---|---|
| DE | 197 21 507 A1 | 11/1997 |
| EP | 0 507 510 A1 | 10/1992 |
| EP | 0 466 512 B1 | 6/1994 |
| EP | 0 667 387 A2 | 8/1995 |
| EP | 0668 899 B1 | 9/2000 |
| GB | 2 313 381 A | 11/1997 |

OTHER PUBLICATIONS

Faix, Louis J.; A study in the Effects of Manganese Fuel Additive on Automotive Emissions; SAE [Tech. Pap.], 780002, pp. 1–12.

Fekete,Nicholas; Gruden, Igor; Voigtlander, Dirk; Nester, Ulrich; Krutzsch, Bernd; Willand, Jurgen; and Kuhn, Michael; Advanced Engine Control and Exhaust Gas After-treatment of a Leanbum SI Engine; SAE [Tech. Pap] 972873; pp. 1–10.

Valentine, James M.; Clean Diesel Technologies Inc. Announces Test Results of Platinum/Cerium Diesel Fuel Additive; 203/327–7050, article in Diesel/Net News; Sep. 20, 2002, pp. 1–2.

Eastwood, Peter; Critical Topics in Exhaust Gas Aftertreatment; Research Studies Press Ltd. (2000), pp. 215–218.

Lenane, D. L.; Effect of MMT on Emissions from Production Cars; SAE [Tech. Pap.], 780003, pp. 1–20.

(Continued)

*Primary Examiner*—Gregory R. Delcotto
(74) *Attorney, Agent, or Firm*—Dennis H. Rainear; Leah Oubre Robinson; Paige J. Thomson

(57) ABSTRACT

A method and composition for suppressing coal dust include a metal-containing compound, such as an organo-manganese, that provides the additional benefit of being a combustion improver. The organometallic compound is mixed with any appropriate dust suppressant liquid. The organometallic compound may include methylcyclopentadienyl manganese tricarbonyl.

13 Claims, No Drawings

OTHER PUBLICATIONS

Lenane, D. L.; Effect of a Feul Additive on Emission Control Systems; sae [Tech. Pap.] 902097, pp. 1–17.
Farrauto, Robert J.; Mooney, John J.; Effects of Sulfur on Performance of Catalytic Aftertreatment Devices; SAE [Tech. Pap.] 920557, pp. 1–7.
Jelles, S.J.; Makkee, M.; Moulijn, J.A.; Acres, G.J.K.; and Peter–Hoblyn, J.D., Diesel Particulate Control Application of an Activated Particulate Trap in Combination with Fuel Additives at an Ultra Low Dose Rate; SAE [Tech. Pap.], 1999–01–0113, pp. 1–6.
Eolys™ Fuel–Borne Catalyst for Diesel Particulates Abatement: A Key Component of an Integrated System, DieselNet Technical Report, Sep. 1999, pp. 1–9.
Guyon, M.; Blejean, F.; Bert, C.; LeFaou, PH.; Impact of Sulfur on Nox Trap Catalyst Activity–Study of the Regeneration Conditions; SAE [Tech. Pap.] 982607, pp. 87–95.
Arakawa, Kenji; Matsuda, Satoshi; and Kinoshita, Hiroo; Progress in Sulfur Poisoning Resistance of Lean NOx Catalysts; SAE [Tech Pap.] 980930, pp. 111–118.
Dearth, Mark A.; Hepbum, Jeffrey S.; Thanasiu, Eva; McKenzie, JoAnne; Horne, Scott G.; Sulfur Interaction with Lean Nox Traps: Laboratory and Engine Dynamometer Studies; SAE [Tech. Pap.] 982595, 1998, pp. 1–9.
Aradi, Allen A.; Roos, Joseph W.; Fort, Jr., Ben F.; Lee, Thomas E.; and Davidson, Robert I.; The Physical and Chemical Effect of Manganese Oxides on Automobile Catalytic Converters; SAE [Tech. Pap.] 940747, pp. 207–218.
Bailie, J. D.; Michalski, G. W.; Unzelman, G. H., MMT–A Versatile Antiknock; Natl. Pet. Refiners Assoc., [Tech. Pap.], AM–78–36, pp. 1–20.
Valentine, James M.; Peter–Hoblyn, Jeremy D.; and Acres. G.K., Emissions Reduction and Improved Fuel Economy Performance from a Bimetallic Platinum/Cerium Diesel Fuel Additive at Ultra–Low Dose Rates; SAE [Tech. Pap], 2000–01–1934, pp. 1–9.
Guinther, Greg H.; Human, David M.; Miller, Keith T.; Roos, Joseph W.; and Schwab, Scott D.; The Role that Methylcyclopentadienyl Manganese Tricarbonyl (MMT®) Can Play in Improving Low–Temperature Performance of Diesel Particulate Traps; SAE [Tech. Pap.], 2002–01–2728, pp. 1–9.
Nelson, A.J.,; Rerreira, J.L.; Reynolds, J.G.; Schwab, S.D.; and Roos, J.W.; X–Ray Absorption Characterization of Diesel Exhaust Particulates; Article in Materials Research Society Symposium Proceedings, vol. 590, 2000, pp. 63–69.
Linteris G. et al., Final Report: Non–Toxic Metallic Fire Suppressants, National Institute of Standards and Technology, Technology Administration, U.S. Department of Commerce, May 2002, Section 3.5, p. 53 et seq. http://fire.nist.gov/bfrlpubs/fire02/PDF/f02011.pdf.
Membrey, W.B., "Fundamentals of Dust Suppression During Coal Handling," Australian Coal Industry Research Laboratories Ltd. (Apr. 1981), P.R. 82–2, ISBN 0 86772 072 7.

* cited by examiner

METHOD AND COMPOSITION FOR SUPPRESSING COAL DUST

FIELD OF THE INVENTION

The present invention relates to a method and composition for suppressing coal dust. The method and composition also simultaneously include an additive for improving the combustion of the coal. Specifically, the method and composition relate to the application of a manganese-containing compound with the dust suppressant to the coal during handling and prior to the combustion of the coal.

BACKGROUND

The problems of coal dust are well known. This problem is encountered throughout the coal handling industry—at the mine, at transfer points, and at utilities or at other points of utilization. The problem may be compounded as a result of the close proximity of transfer points and utilities to populated or environmentally sensitive areas.

Conventional dust suppression systems include both mechanical and chemical methods. For instance, dust collection equipment includes devices which capture entrained dust, induce the dust to settle, or contain the dust. The most common dust suppression method, however, is the wetting of coal with water. Water is inexpensive and large quantities can be added to eliminate dust. But the addition of water decreases the specific heating value of the coal.

In addition to water alone, other aqueous additives are known and used. These include solutions containing surfactants. Aqueous foams are known. Still further, aqueous compositions comprising asphalt emulsions or other organic coating materials may be used.

It is also known to apply oils and resins to reduce or eliminate dust. Oil spraying includes the use of crude, residual, waste or fuel oils.

Other liquids that may be applied to the coal to reduce dust include both synthetic and natural polymers. For instance, plant-material-containing liquids including sugar and sugar-related products are known. Other polymers that collect or stick to the dust particles have also been used.

Unrelated to the issue of reducing coal dust, it is also desirable to improve the complete combustion of coal. Carbon in fly ash results from the incomplete combustion of coal. Therefore, it is desirable to reduce the carbon in ash in order to reduce the overall amount of fly ash emission from a coal combustion chamber. Also, low carbon fly ash is easier to dispose of and more easily captured than high carbon fly ash by electrostatic precipitators that are often used to control particulate emissions.

DESCRIPTION OF EMBODIMENTS OF THE INVENTION

The present invention is directed to enhancing a liquid for coal dust suppression by adding a metal-containing compound to that liquid. The metal-containing additive is a combustion-improver. The addition of the combustion improver concurrently with the dust suppressant allows the coal handler to solve the issues of dust suppression and combustion improvement with a single process step of adding the single mixture of and applying it in one application to the coal.

A broad range of liquids that may be added to coal to suppress dust from the coal is explained in detail in the literature. These liquids include water, oil, surfactants, polymer dispersions, polymer solutions, flocculants, and resins, and mixtures of one or more of the foregoing. See particularly Membry, W. B., "Fundamentals of Dust Suppression During Coal Handling", Australian Coal Industry Research Laboratories Limited (1981), P.R. 82-2, ISBN 0 86772 072 7. A manganese-containing compound may be added to any dust suppressant liquids including those conventional liquids noted above. The result may be a solution, emulsion, mixture, or any other combination of the foregoing.

As indicated earlier, dust suppressants may be applied at different stages of the coal handling process. They may be applied multiple times during the process. The mixture that results from the combination of a metal-containing (including but not limited to manganese) compound with the liquid dust suppressant may be applied at any stage of the handling of the coal. The mixture including the metal-containing compound may be added at the end-user stage of the coal handling—i.e., at a utility combustion plant or other furnace. Alternatively, the mining operation may combine the metal-containing compound with the liquid dust suppressant in its operations in order to improve the properties of the coal for sale. The metals can include manganese, iron, cerium, copper, molybdenum, platinum group metals, alkali and alkaline earth metals, and other metals known to catalyst carbon oxidation in combustion systems.

In order to enhance the effectiveness of manganese as a catalyst to the combustion reaction, the manganese compound that is mixed with the coal must make the manganese available in a mononuclear or small cluster fashion. In this way, more manganese is dispersed on the coal (carbon) particles during combustion.

It is hypothesized that the significant level of manganese that is naturally occurring in coal does not have an appreciable affect in improving combustion and lowering the amount of carbon in fly ash, because the manganese is bound together in crystalline forms such as with sulfur or phosphorous. Therefore, there is not a significant amount of mononuclear or small cluster manganese atoms available to surround and catalyze the combustion of coal (carbon) particles. The effect on combustion of naturally occurring manganese, therefore, appears to be negligible.

Clusters of from 3 to 50 atom size and above are dynamically created in the flame being fed with fuel containing the metal additive as a monoatomic to 3 metal atom size compounds. These clusters are generally too reactive to be isolated at ambient conditions.

Measurement of metal cluster size distribution in the flame versus intended metal catalysis has been carried out by Linteris, G., Rumminger, M., Babushok, V., Chelliah, H., Lazzarini, T., and Wanigarathne, P. *Final Report: Non-Toxic Metallic Fire Suppressants*. National Institute of Standards and Technology (NIST), Technology Administration, U.S. Department of Commerce, May 2002. http:// fire.nist.gov/bfrlpubs/fire02/PDF/f02011.pdf., section 3.5, titled "Laser Scattering Experiments of Particles in Fe(CO)5—Inhibited Flames" beginning on page 53 of the report.

The term "mononuclear" compound includes one where a manganese atom is bound in a compound which is essentially soluble. An example is an organometallic manganese compound that is soluble in various organic solvents. Compounds have "small clusters" of metal atoms include those with 2 to about 50 atoms of manganese. In this alternative, the metal atoms are still sufficiently dispersed or dispersable to be an effective catalyst for the combustion reaction. When discussing solubility in terms of mononuclear and small cluster atoms, the term solubility means both fully dissolved in the traditional sense, but also partially dissolved or suspended in a liquid medium. As long as the manganese atoms are adequately dispersed in terms of single atoms or up to about 50 atom clusters, the manganese atoms are sufficient to provide a positive catalytic effect for the combustion reaction.

Examples of metal compound clusters between 2 and 50 atoms are rare at ambient conditions but very common in flames being fed with fuel containing the metal atom in monoatomic to three metal atom cluster forms. In the case of manganese, there are numerous monoatomic compounds that include methycyclopentadienyl manganese tricarbonyl (MMT), manganocene, and many other monomanganese organometallics that exist in the literature. There are also bimetallics such as manganese heptoxide ($Mn_2O_7$), manganese decacarbonyl [$Mn_2(CO)_{10}$], etc. An example of a trinuclear manganese cluster is manganese II citrate, [$Mn_3(C_6H_5O_7)_2$]. Clusters from 2 to 50 atoms and above are dynamically formed in the flame front as a function of the combustion process. These are unstable reactive species whose cluster size distribution is kinetically and thermodynamically balanced by the combustion process they are participating in.

Beginning with monoatomic manganese compounds such as MMT, it is possible to generate in-situ clusters ranging in size from three metal atoms all the way to above 500 metal atoms. This is a thermodynamically favored process that is promoted by any mechanism that strips the organic ligands away from the metal atoms. These ligands stabilize the metal in the atomic state and their removal forces the metal atoms to seek each other and bind together in ever growing cluster size in order to achieve stability. The more atoms that come together in this manner, the more stable the cluster. The larger the cluster, the less effective the metal becomes as a combustion catalyst. Combustion brings together several mechanism that promote metal cluster formation, such as temperature, oxygen, and fuel-related free radicals that react the ligands away from the metal atom.

Increase in temperature, on the one hand, promotes cluster formation by stripping away the stabilizing ligands. However, if the temperature remains high such as that measured in the flame front, i.e., 2500° C. and above, then the atoms are kinetically forced to remain segregated in this zone.

On either sides of the flame front (fuel intake side and exhaust side) a temperature gradient is established that decreases away from the flame front. The naked metal atoms created in the flame front flow thermophoretically (a thermodynamic requirement) away from the flame front and down these temperature gradients. As temperature decreases, the kinetic forces maintaining atomic segregation decrease and the atoms condense together in ever growing cluster sizes to achieve thermodynamic stability. The most effective form of a metal as a combustion catalyst is the monoatomic form which presents maximum surface area to the gas phase reactions (combustion). Since it is a given that temperature and oxygen are intricate parts of combustion, cluster formation rate can not be modulated through these two parameters. That leaves initial organometallic compound thermal and air stability, dilution in the combusting fuel—air charge, and the pressure of the input charge into the combustion flame front as factors to be modulated to maintain or increase catalyst activity.

Examples of mononuclear compounds include organometallic compounds having an organo group and at least one metallic ion or atom. Preferred organo groups in the organometallic compounds in an embodiment of the present invention include alcohols, aldehydes, ketones, esters, anhydrides, sulfonates, phosphonates, chelates, phenates, crown ethers, naphthenates, carboxylic acids, amides, acetyl acetonates, and mixtures thereof. Manganese containing organometallic compounds can include, for example, manganese tricarbonyl compounds. Such compounds are taught, for example, in U.S. Pat. Nos. 4,568,357; 4,674,447; 5,113,803; 5,599,357; 5,944,858 and European Patent No. 466 512 B 1.

Suitable manganese tricarbonyl compounds which can be used include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. One example is the cyclopentadienyl manganese tricarbonyls which are liquid at room temperature such as methylcyclopentadienyl manganese tricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc.

Preparation of such compounds is described in the literature, for example, U.S. Pat. No. 2,818,417, the disclosure of which is incorporated herein in its entirety.

Examples of manganese compounds having small clusters of 2 to about 50 atoms include those recited hereinabove. Other examples include non-volatile, low cluster size (1–3 metal atoms) manganese compounds such as bis-cyclopentadienyl manganese, bis-methyl cyclopentadienyl manganese, manganese naphthenate, manganese 11 citrate, etc, that are either water or organic soluble. Further examples include non-volatile, low cluster manganese compounds embedded in polymeric and/or oligomeric organic matrices such as those found in the heavy residue from the column distillation of crude MMT. Additional non-manganese examples include non-volatile, low cluster size compounds of metals selected from iron, cerium, copper, molybdenum, platinum group metals, alkali and alkaline earth metals, and other metals known to catalyze carbon oxidation in combustion systems.

The treat rate of the manganese compound with the coal is between 1 to about 500 ppm by weight. An alternative treat rate is from about 5 to 100 ppm by weight manganese. In a further embodiment, the treat rate is 20 ppm by weight manganese to the coal.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as formation of the organometallic compound) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations or immediately thereafter is thus wholly immaterial for an accurate understanding and appreciation of this disclosure and the claims thereof.

At numerous places throughout this specification, reference has been made to a number of U.S. Patents, published foreign patent applications and published technical papers. All such cited documents are expressly incorporated in full into this disclosure as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Applicant does not intend to dedicate any disclosed embodiments to the public, and to the extent any disclosed modifications or alterations may not literally fall within the scope of the claims, they are considered to be part of the invention under the doctrine of equivalents.

What is claimed is:

1. A method of suppressing dust from coal, the method comprising the steps of:

providing a manganese-containing compound that is an organometallic compound containing an organo group and at least one manganese ion or atom;

providing a dust-suppressing liquid selected from the group consisting of surfactants, polymer dispersions, polymer solutions, and mixture thereof;

combining the manganese-containing compound with the dust-suppressing liquid to form a mixture; and contacting the mixture of manganese-containing compound and dust-suppressing liquid with coal;

wherein the mixture is contacted with the coal in an amount effective to suppress the generation of dust from the coal.

2. The method as described in claim 1, wherein the organo group of the organometallic compound is selected from the group consisting of alcohols, aldehydes, ketones, esters, anhydrides, sulfonates, phosphonates, chelates, phenates, crown ethers, naphthenates, carboxylic acids, amides, acetyl acetonates and mixtures thereof.

3. The method described in claim 1, wherein the organometallic compound comprises methylcyclopentadienyl manganese tricarbonyl.

4. The method described in claim 1, wherein the manganese-containing compound is selected from the following group: cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, including mixtures of two or more such compounds.

5. The method as described in claim 1, wherein the manganese-containing compound comprises about 20 ppm by weight of the coal.

6. The method as described in claim 1, wherein the manganese-containing compound comprises about 5 to 100 ppm by weight of the coal.

7. The method as described in claim 1, wherein the manganese-containing compound comprises about 1 to 500 ppm by weight of the coal.

8. The method as described in claim 1, wherein the manganese-containing compound is a mononuclear metal compound.

9. The method as described in claim 1, wherein the manganese-containing compound comprises clusters of about two to no more than about fifty metal atoms.

10. The method as described in claim 1, further wherein the mixture is contacted with the coal in an amount effective to improve combustion of the coal.

11. The method described in claim 1, further wherein the manganese-containing compound comprises at least one non-volatile, low cluster size (1–3 metal atoms) manganese compound selected from the group consisting of bis-cyclopentadienyl manganese, bis-methyl cyclopentadienyl manganese, manganese naphthenate, and manganese II citrate.

12. The method described in claim 1, further wherein the manganese-containing compound comprises non-volatile, low cluster manganese compounds embedded in polymeric and/or oligomeric organic matrices.

13. A method of suppressing dust from coal, the method comprising the steps of:

providing a mixture of a manganese-containing compound that is an organometallic compound containing an organo group and at least one manganese ion or atom and a dust-suppressing liquid selected from the group consisting of surfactants, polymer dispersions, polymer solutions, and mixtures thereof; and contacting the mixture of manganese-containing compound and dust-suppressing liquid with coal;

wherein the mixture is contacted with the coal in an amount effective to suppress the generation of dust from the coal.

* * * * *